US011892240B2

(12) United States Patent
Lin

(10) Patent No.: US 11,892,240 B2
(45) Date of Patent: Feb. 6, 2024

(54) COMBINATION STRUCTURE OF VAPOR CHAMBER AND HEAT PIPE

(71) Applicant: TAIWAN MICROLOOPS CORP., New Taipei (TW)

(72) Inventor: Chun-Hung Lin, New Taipei (TW)

(73) Assignee: TAIWAN MICROLOOPS CORP., New Taipei (TW)

( * ) Notice: Subject to any disclaimer, the term of this patent is extended or adjusted under 35 U.S.C. 154(b) by 0 days.

(21) Appl. No.: 17/826,121

(22) Filed: May 26, 2022

(65) Prior Publication Data

US 2023/0349644 A1 Nov. 2, 2023

(51) Int. Cl.
*F28D 15/02* (2006.01)
*F28D 15/04* (2006.01)

(52) U.S. Cl.
CPC ..... *F28D 15/0275* (2013.01); *F28D 15/0233* (2013.01); *F28D 15/046* (2013.01)

(58) Field of Classification Search
CPC . F28D 15/0275; F28D 15/0233; F28D 15/046
USPC ..... 165/104.26
See application file for complete search history.

(56) References Cited

U.S. PATENT DOCUMENTS 10,048,017 B2 * 8/2018 Lan ..... H01L 23/427
10,677,535 B1 * 6/2020 Kawabata ..... F28D 15/0275
2010/0051239 A1 * 3/2010 Lin ..... F28D 15/0233 29/890.032
2010/0077615 A1 * 4/2010 Hou ..... B23P 15/26 29/890.039
2010/0326629 A1 * 12/2010 Meyer, IV ..... F28D 15/0233 165/104.33
2011/0108243 A1 * 5/2011 Hou ..... F28D 15/046 165/104.26
2012/0227935 A1 * 9/2012 Huang ..... B21D 41/04 29/890.032
2016/0003555 A1 * 1/2016 Sun ..... F28D 15/046 165/104.26
2018/0066896 A1 * 3/2018 Lin ..... F28D 15/046
2018/0292145 A1 * 10/2018 Sun ..... F28D 15/0275
2019/0131204 A1 * 5/2019 Gaskill ..... G06F 1/203
2020/0248968 A1 * 8/2020 Chen ..... F28D 15/04
2020/0315064 A1 * 10/2020 Agostini ..... H05K 7/20336
2020/0333081 A1 * 10/2020 Kishimoto ..... H05K 7/20336
(Continued)

*Primary Examiner* — Len Tran
*Assistant Examiner* — Gustavo A Hincapie Serna
(74) *Attorney, Agent, or Firm* — Chun-Ming Shih; HDLS IPR SERVICES

(57) ABSTRACT

A combination structure of a vapor chamber and a heat pipe includes a half-shell seat element, a half-shell cover element, a wick structure, and a working fluid. The half-shell seat element includes a vapor chamber half-shell seat and multiple heat pipe half-shell seats. Each heat pipe half-shell seat is extended from the vapor chamber half-shell seat. The vapor chamber half-shell seat includes a vapor chamber cavity. Each heat pipe half-shell seat includes a heat pipe cavity. Each heat pipe cavity communicates with the vapor chamber cavity. The half-shell cover element is sealedly connected with the half-shell seat element. The wick structure is continuously laid on the vapor chamber half-shell seat and each heat pipe half-shell seat, and is formed in the vapor chamber cavity and each heat pipe cavity. The working fluid is disposed in the vapor chamber cavity.

8 Claims, 6 Drawing Sheets

(56) References Cited

U.S. PATENT DOCUMENTS

| | | | | |
|---|---|---|---|---|
| 2020/0355444 | A1* | 11/2020 | Chen | F28D 15/0283 |
| 2021/0136955 | A1* | 5/2021 | Wakaoka | F28D 15/046 |
| 2021/0180876 | A1* | 6/2021 | Kojima | H01L 23/427 |
| 2022/0163267 | A1* | 5/2022 | Liu | F28F 3/06 |
| 2022/0295668 | A1* | 9/2022 | Namboori | H05K 7/20336 |
| 2023/0047466 | A1* | 2/2023 | Jiang | F28D 15/0266 |
| 2023/0122387 | A1* | 4/2023 | Lin | F28D 15/046 165/77 |

* cited by examiner

COMBINATION STRUCTURE OF VAPOR CHAMBER AND HEAT PIPE

BACKGROUND

Technical Field

The disclosure relates to a cooler technology, particularly to a combination structure of a vapor chamber and a heat pipe.

Description of Related Art

With the improvement of booting speed and software reading speed of computers, the heat and temperature of the internal electronic components during operation also increase continuously. In addition to the rapid aging of most electronic components, high temperature also reduces the reading and writing speed of electronic components such as solid-state drives. Thus, how to keep the working temperature is an issue of the disclosure.

To solve the above cooling problem of the electronic components, the industry has developed high-performance cooling elements such as heat pipes and vapor chambers. The above cooling elements have gradually become primary coolers of electronic components due to the cooling ability of the light weight and high performance.

However, in the manufacturing process, in addition to the need to dispose a large of molds to perform the steps of punching, blanking, and folding, the disposition of the wick structure is an important factor related to the ability of its capillary adsorption. The wick structures of a related-art vapor chamber and a heat pipe are usually made individually and then the wick structure in the vapor chamber and the wick structure in the heat pipe are connected by secondary processing. The wick structures made by the above manner are not a continuous structure, so their capillary absorption ability is not good enough. Also, the manufacture of the above structure of vapor chamber and heat pipe is very cumbersome and complicated. Obviously, it has been unable to satisfy the current using requirements.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

SUMMARY

An object of the disclosure is to provide a combination structure of a vapor chamber and a heat pipe, which is manufactured easily and the wick structure is evenly distributed to make the capillary adsorption strong.

To accomplish the above object, the disclosure provides a combination structure of a vapor chamber and a heat pipe, which includes a half-shell seat element, a half-shell cover element, a wick structure, and a working fluid. The half-shell seat element includes a vapor chamber half-shell seat and multiple heat pipe half-shell seats. Each heat pipe half-shell seat is extended from the vapor chamber half-shell seat. The vapor chamber half-shell seat includes a vapor chamber cavity. Each heat pipe half-shell seat includes a heat pipe cavity. Each heat pipe cavity communicates with the vapor chamber cavity. The half-shell cover element is sealedly connected with the half-shell seat element. The wick structure is continuously laid on the vapor chamber half-shell seat and each heat pipe half-shell seat, and is formed in the vapor chamber cavity and each heat pipe cavity. The working fluid is disposed in the vapor chamber cavity.

The disclosure further has the following functions. By the interchangeability or commonality of the half-shell cover element and the half-shell seat element, the costs of making molds and inventory management may be effectively saved.

DETAILED DESCRIPTION

Figure 1:
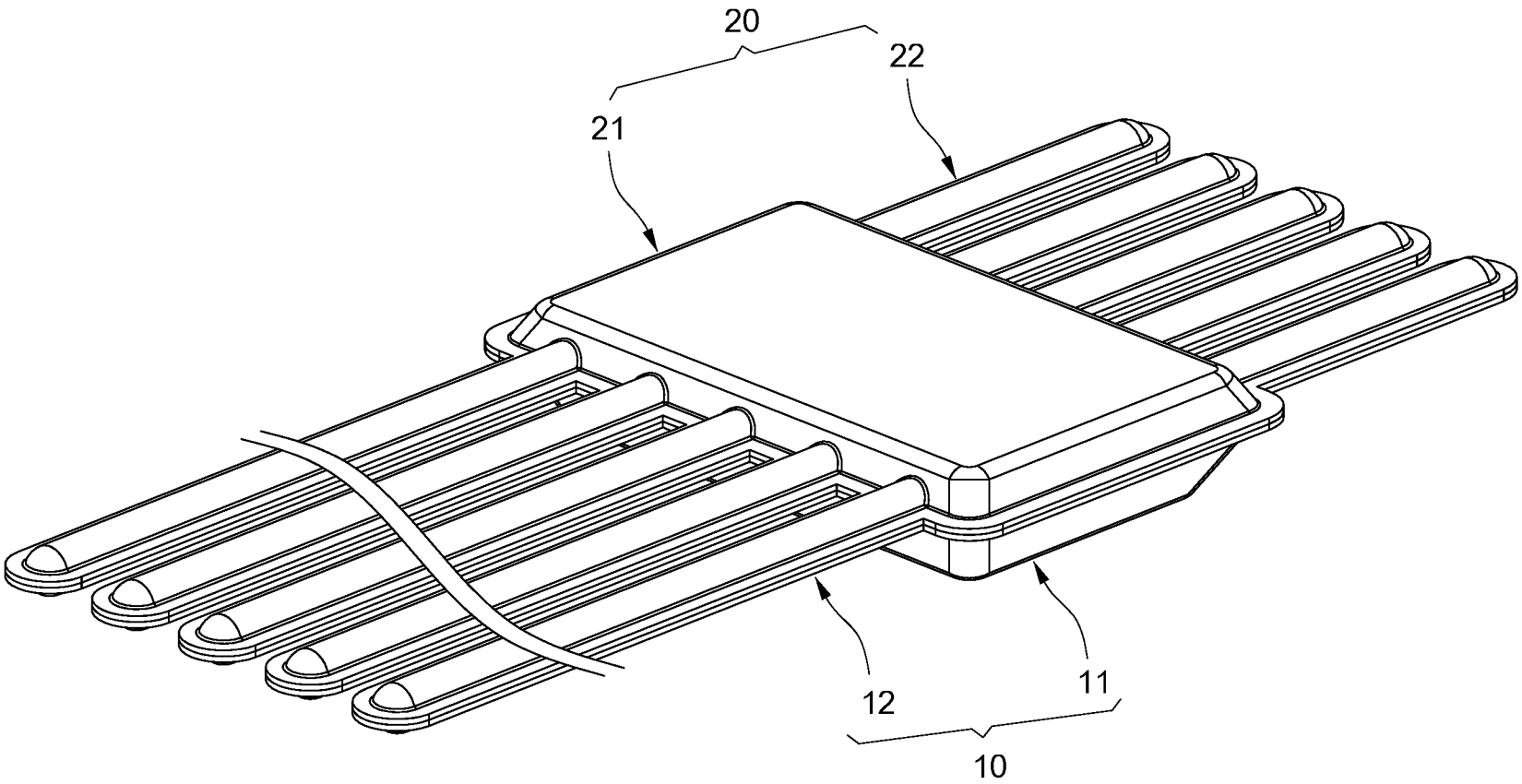
FIG. 1 is a perspective view of the combination structure of a vapor chamber and a heat pipe of the disclosure.
Figure 2:
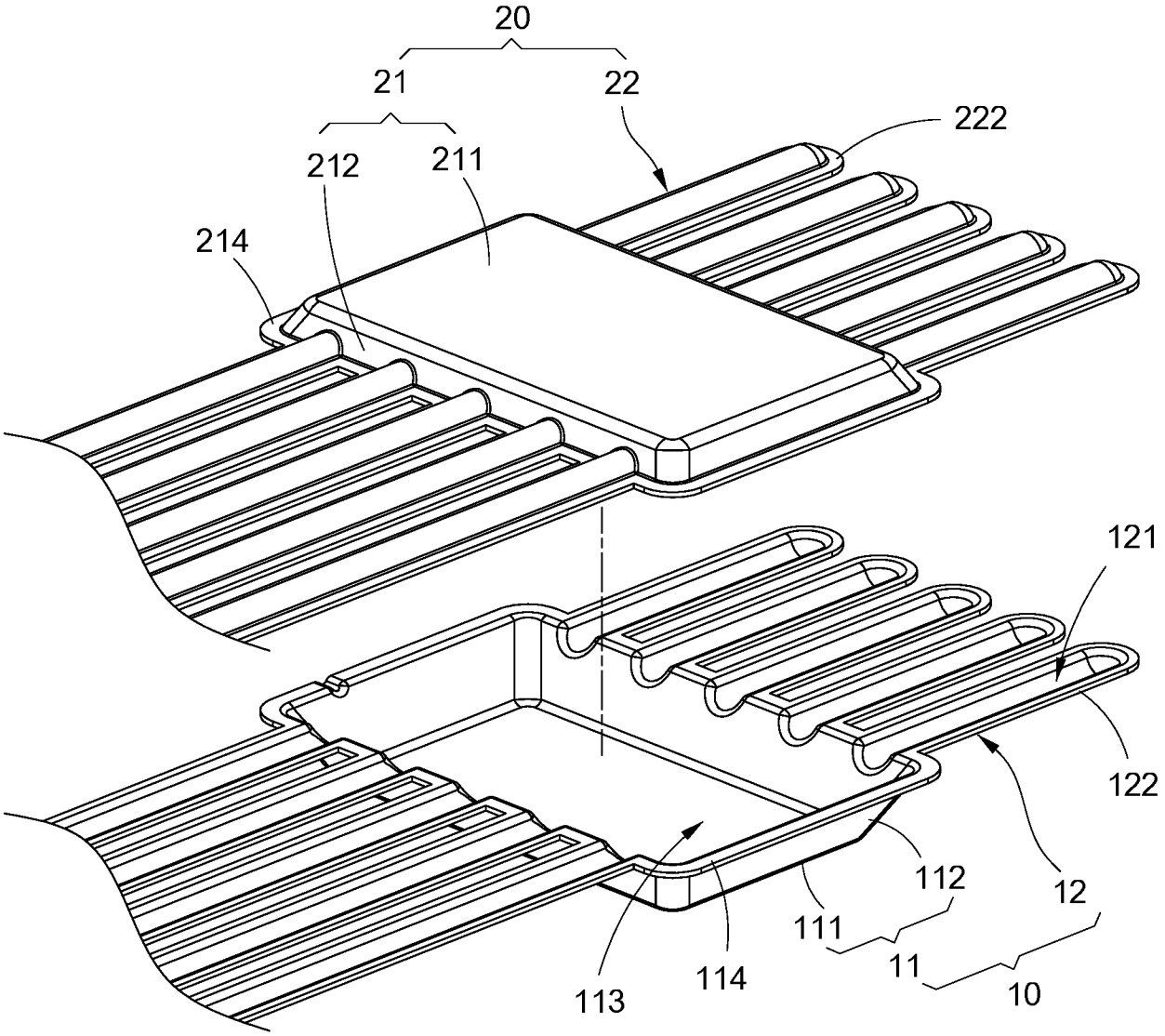
FIG. 2 is an exploded view of the half-shell seat element and the half-shell cover element of the disclosure.
Figure 3:
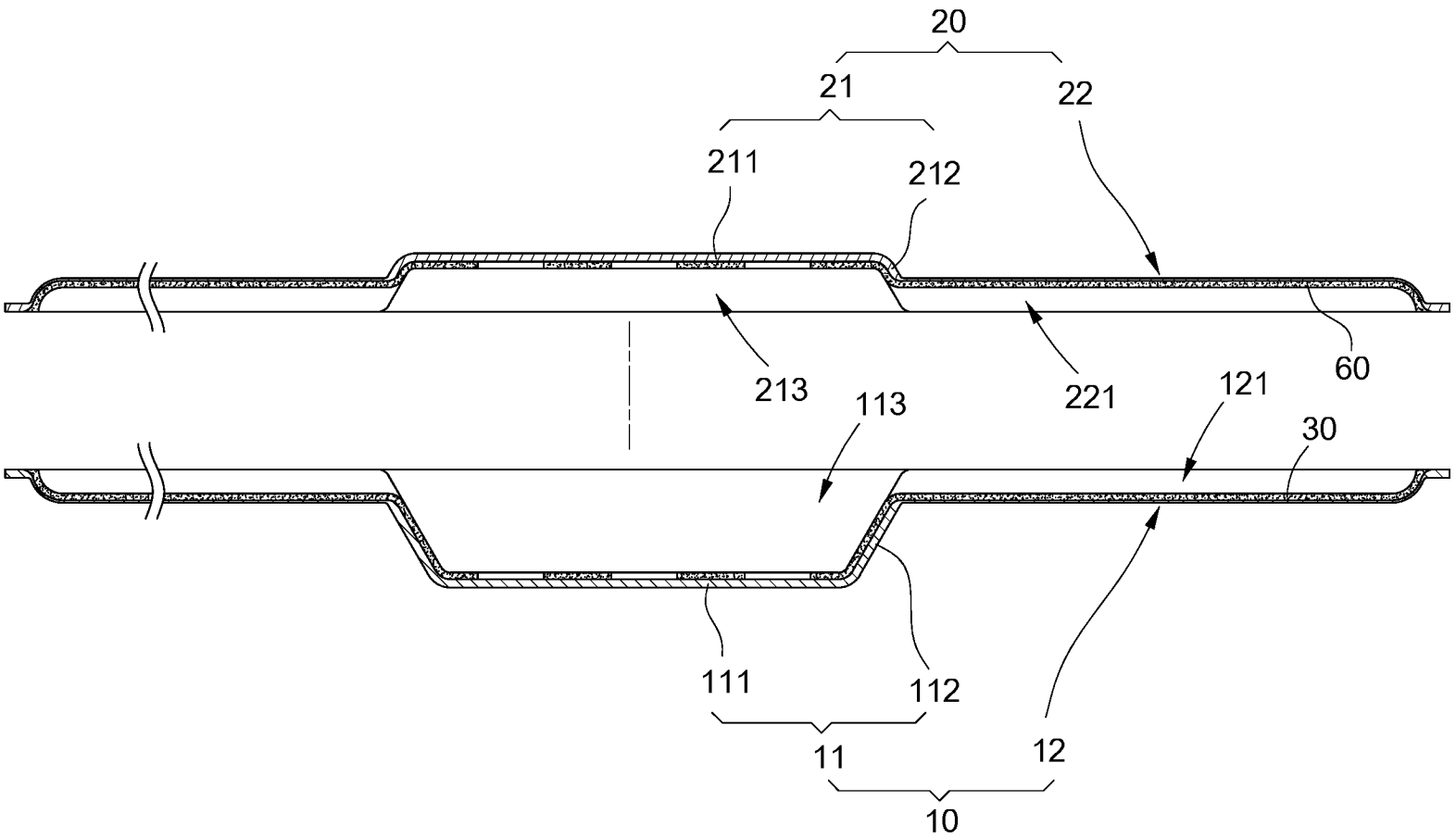
FIG. 3 is an exploded cross-sectional view of the half-shell seat element and the half-shell cover element of the disclosure.
Figure 4:
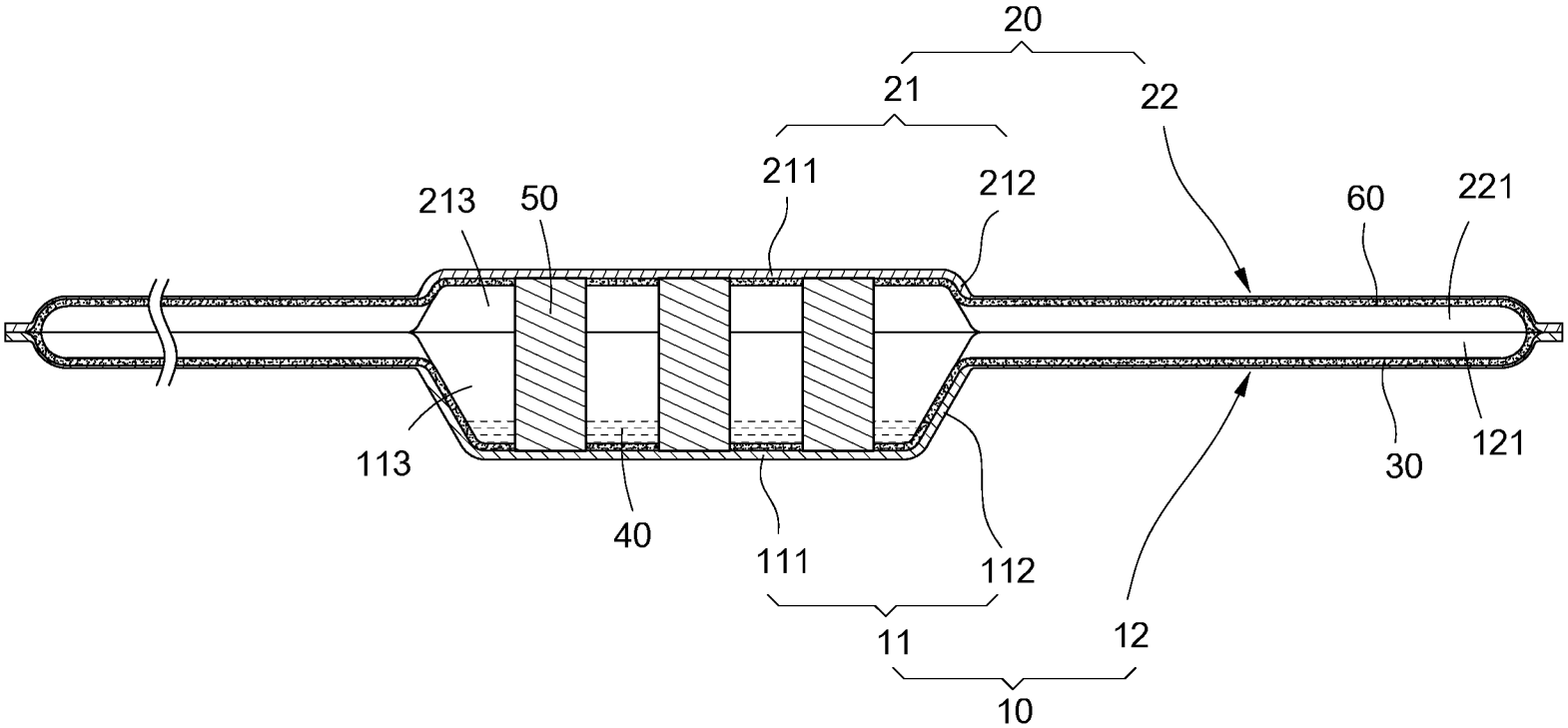
FIG. 4 is a cross-sectional view of the combination structure of a vapor chamber and a heat pipe of the disclosure.
Figure 5:
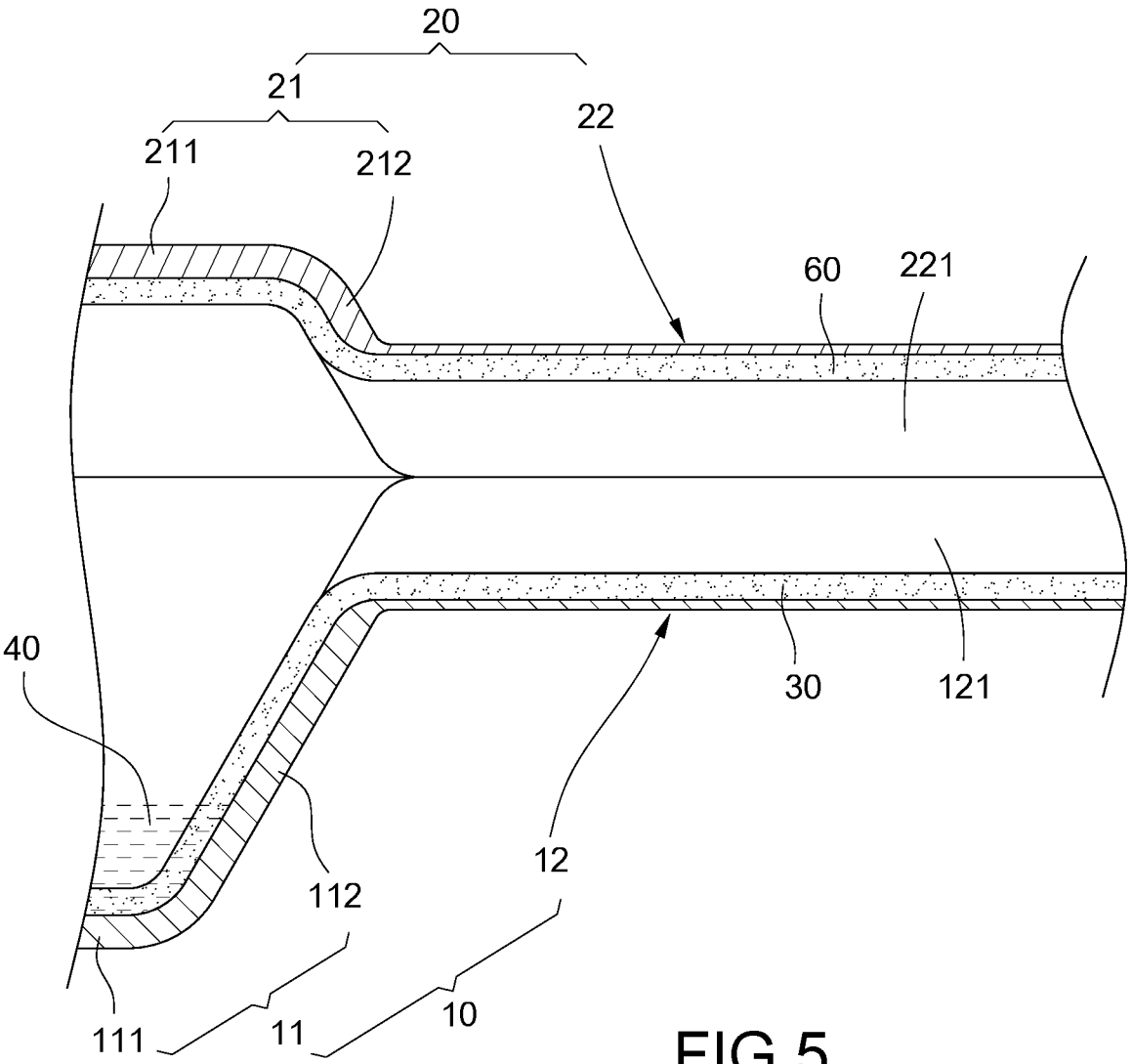
FIG. 5 is a partially enlarged view of FIG. 4.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIGS. 1-5. The disclosure provides a combination structure of a vapor chamber and a heat pipe, which includes a half-shell seat element 10, a half-shell cover element 20, a wick structure 30 and a working fluid 40.

The half-shell seat element 10 is made of a material with desirable thermo-conductivity, such as copper, aluminium, magnesium, or an alloy thereof. The half-shell seat element 10 includes a vapor chamber half-shell seat 11 and multiple heat pipe half-shell seats 12. The vapor chamber half-shell seat 11 is of a substantially rectangular shape and includes a bottom plate 111 and a lower surrounding plate 112 upward extended from a periphery of the bottom plate 111. A vapor chamber cavity 113 is formed jointly by the bottom plate 111 and the lower surrounding plate 112. An end of the lower surrounding plate 112, which is away from the bottom plate 111, is extended with a first flange 114.

Each heat pipe half-shell seat 12 is extended from an upper end of the lower surrounding plate 112 of the vapor chamber half-shell seat 11 and has a cross-section with a substantially semi-circular shape. The inside of each heat pipe half-shell seat 12 has a heat pipe cavity 121, and each heat pipe cavity 121 communicates with the vapor chamber cavity 113. An opening end of each heat pipe half-shell seat 12 is outward extended with a second flange 122. Each second flange 122 is connected with the first flange 114.

The vapor chamber half-shell seat 11 and each heat pipe half-shell seat 12 are integrally formed (or in one-piece formed) by a stamping and extension process.

The half-shell cover element 20 is sealedly connected with the half-shell seat element 10 and is also made of a material with desirable thermo-conductivity, such as copper, aluminium, magnesium, or an alloy thereof. The half-shell cover element 20 includes a vapor chamber half-shell cover 21 and multiple heat pipe half-shell covers 22. The vapor chamber half-shell cover 21 is of a substantially rectangular shape and includes a top plate 211 and an upper surrounding plate 212 upward extended from a periphery of the top plate 211. Another vapor chamber cavity 213 is formed jointly by the top plate 211 and the upper surrounding plate 212. An end of the upper surrounding plate 211, which is away from the top plate 211, is extended with a third flange 214.

Each heat pipe half-shell cover 22 is extended from a lower end of the upper surrounding plate 212 of the vapor chamber half-shell cover 21 and has a cross-section with a substantially semi-circular shape. The inside of each heat pipe half-shell cover 22 has another heat pipe cavity 221 and each another heat pipe cavity 221 communicates with the another vapor chamber cavity 213. An opening end of each heat pipe half-shell cover 22 is outward extended with a fourth flange 222. Each fourth flange 222 is connected with the third flange 214.

The vapor chamber half-shell cover 21 and each heat pipe half-shell cover 22 are integrally formed (or in one-piece formed) by a stamping and extension process. The half-shell cover element 20 and the half-shell seat element 10 have interchangeability or commonality for use.

The wick structure 30 is continuously laid on the vapor chamber half-shell seat 11 and each heat pipe half-shell seat 12, and is formed in the vapor chamber cavity 113 and each heat pipe cavity 121. The phrase "continuously laid on" means that the base of the wick structure evenly covers the inner surfaces of the bottom plate 111 and the lower surrounding plate 112, and the wick structure 30 is adhered on the inner surfaces of the bottom plate 111 and the lower surrounding plate 112 by a sintering process or a thermal diffusion welding process. In other words, the wick structure 30 is formed integrally (or formed in one piece).

In an embodiment, the wick structure 30 may be formed by a material with desirable capillary adsorption, such as woven metal mesh, porous sintered powder, or fiber bundles.

The working fluid 40 may be pure water. The working fluid 40 is filled in the vapor chamber cavity 113 and then degassed and sealed so as to make the vapor chamber cavity 113 and each heat pipe cavity 121 form a vacuum chamber.

In an embodiment, the combination structure of the vapor chamber and the heat pipe of the disclosure further includes multiple support posts 50 which may be made of a material with desirable thermo-conductivity, such as copper, aluminium, magnesium, or an alloy thereof. In an embodiment, the support post 50 is a solid cylinder and two end faces of each support post 50 separately abut against the bottom plate 111 and the top plate 211.

In an embodiment, the combination structure of the vapor chamber and the heat pipe of the disclosure further includes another wick structure 60. The another wick structure 60 is continuously laid on the vapor chamber half-shell cover 21 and each heat pipe half-shell cover 22, and is formed in the another vapor chamber cavity 213 and each another heat pipe cavity 221.

When assembling, the first flange 114 of the vapor chamber half-shell seat 11 is correspondingly attached on the third flange 214 of the vapor chamber half-shell cover 21, the second flange 122 of each heat pipe half-shell seat 12 is correspondingly attached on the fourth flange 222 of each heat pipe half-shell cover 22, and a welding process is performed to make the half-shell cover element 20 and the half-shell seat element 10 closely sealed. The vapor chamber half-shell seat 11 and the vapor chamber half-shell cover 21 are assembled to form a rectangular vapor chamber. Each heat pipe half-shell seat 12 and each heat pipe half-shell cover 22 are assembled to form a round heat pipe.

Figure 6:
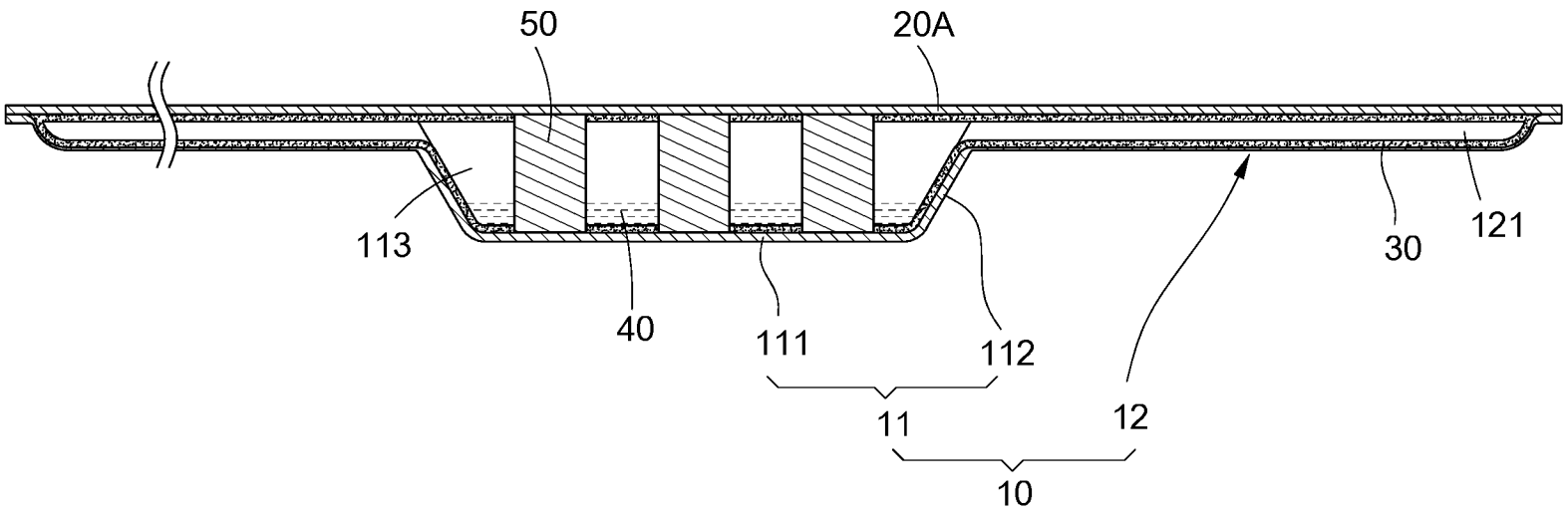
FIG. 6 is a cross-sectional view of another embodiment of the disclosure.

Please refer to FIG. 6. In addition to the above embodiment of the combination structure of the vapor chamber and the heat pipe of the disclosure, the half-shell cover element 20A may also be a flat plate which is closely sealed with the above half-shell seat element 10. Each support post 50 is upright disposed between the vapor chamber half-shell seat 11 and the half-shell cover element 20A.

While this disclosure has been described by means of specific embodiments, numerous modifications and variations could be made thereto by those skilled in the art without departing from the scope and spirit of this disclosure set forth in the claims.

What is claimed is:

1. A combination structure of a vapor chamber and multiple heat pipes, the combination structure comprising:

a half-shell seat element, comprising a vapor chamber half-shell seat and multiple heat pipe half-shell seats, each heat pipe half-shell seat extended from the vapor chamber half-shell seat, the vapor chamber half-shell seat comprising a vapor chamber cavity, each heat pipe half-shell seat comprising a heat pipe cavity, and the heat pipe cavities communicating with the vapor chamber cavity;

a half-shell cover element, sealedly connected with the half-shell seat element;

a wick structure, continuously laid on the vapor chamber half-shell seat and each heat pipe half-shell seat, and disposed in the vapor chamber cavity and each heat pipe cavity; and a working fluid, disposed in the vapor chamber cavity;

wherein the half-shell cover element comprises a vapor chamber half-shell cover and multiple heat pipe half-shell covers, each heat pipe half-shell cover is extended from the vapor chamber half-shell cover, the vapor chamber half-shell cover comprises another vapor chamber cavity, each heat pipe half-shell cover comprises another heat pipe cavities, and the another heat pipe cavities communicates with the another vapor chamber cavity;

wherein the vapor chamber half-shell seat comprises a first flange, each heat pipe half-shell seat comprises a second flange, the vapor chamber half-shell cover comprises a third flange, each heat pipe half-shell cover comprises a fourth flange, the first flange is correspondingly sealed with the third flange, and the second flange is correspondingly sealed with the fourth flange.

2. The combination structure of claim 1, wherein the vapor chamber half-shell seat and the vapor chamber half-shell cover are assembled to be a rectangular vapor chamber, and each heat pipe half-shell seat and each heat pipe half-shell cover are assembled to be a round heat pipe.

3. The combination structure of claim 1, further comprising another wick structure continuously laid on the vapor chamber half-shell cover and each heat pipe half-shell cover and disposed in the another vapor chamber cavity and the another heat pipe cavities.

4. The combination structure of claim 3, wherein the another wick structure is formed integratedly.

5. The combination structure of claim 1, further comprising multiple support posts upright disposed between the vapor chamber half-shell seat and the vapor chamber half-shell cover.

6. The combination structure of claim 1, wherein the vapor chamber half-shell cover and each heat pipe half-shell cover are formed integratedly.

7. The combination structure of claim 1, wherein the wick structure is formed integratedly.

8. The combination structure of claim 1, wherein the vapor chamber half-shell seat and each heat pipe half-shell seat are formed integratedly.

* * * * *